United States Patent [19]

Peters

[11] Patent Number: 4,460,176

[45] Date of Patent: Jul. 17, 1984

[54] POST CONSTRUCTION FOR PINBALL GAME

[75] Inventor: Albin Peters, Chicago, Ill.

[73] Assignee: Wico Corporation, Niles, Ill.

[21] Appl. No.: 353,878

[22] Filed: Mar. 2, 1982

Related U.S. Application Data

[63] Continuation-in-part of Ser. No. 224,850, Jan. 14, 1981, abandoned.

[51] Int. Cl.[3] ..... A63F 7/12

[52] U.S. Cl. ..... 273/127 C; 273/179 R

[58] Field of Search ..... 411/377, 373, 396, 901, 411/902, 903; 273/127 R, 127 C, 118 D, 119 R, 118 R

[56] References Cited

U.S. PATENT DOCUMENTS

| | | | |
|---|---|---|---|
| 1,359,108 | 11/1920 | Rowland | 273/14 |
| 2,189,048 | 2/1940 | Underhill | 16/86 A |
| 3,857,567 | 12/1974 | Goldfarb | 273/127 R X |
| 3,885,492 | 5/1975 | Gutshall | 411/373 |
| 4,168,067 | 9/1979 | Wiczer | 273/127 R |
| 4,295,767 | 10/1981 | Temple | 411/377 |

*Primary Examiner*—George J. Marlo
*Attorney, Agent, or Firm*—Emrich & Dithmar

[57] ABSTRACT

A post construction comprises a post body having an externally threaded stud embedded therein and projecting axially from one end thereof for threaded engagement with the playfield board of a pinball game. A hex surface on the post body facilitates driving the stud into the playfield board. In one embodiment an annular guard flange protects the playfield board during the mounting operation and in another the hex surface is offset a slight distance from the post body end to prevent engagement with the playfield board. In one embodiment an annular recess is provided in the post body around the stud to accommodate whiskers of playfield board material ejected during the threaded mounting to accommodate flush seating on the playfield board. Two circumferential grooves in the outer surface of the post body respectively receive rubber bands for interconnecting a plurality of the post constructions, the grooves being so positioned that the two bands are spaced apart a distance less than the diameters thereof.

12 Claims, 7 Drawing Figures

FIG. 1
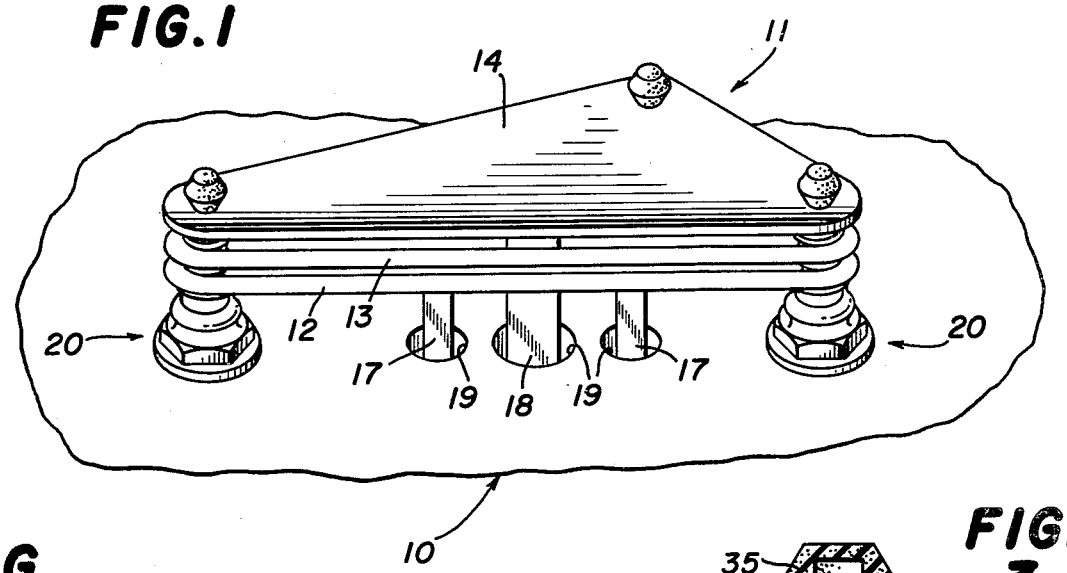
FIG. 2
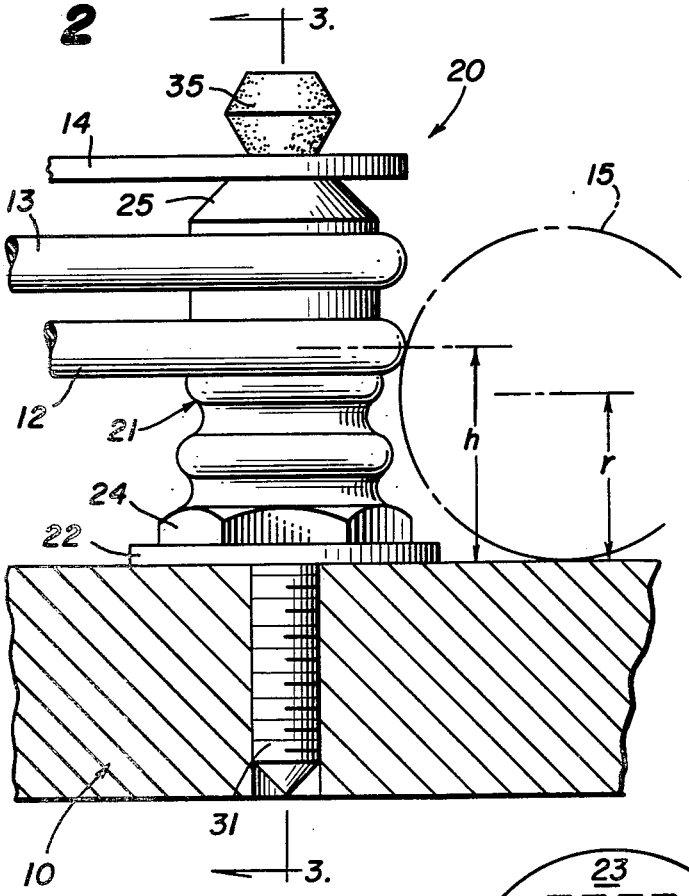
FIG. 3
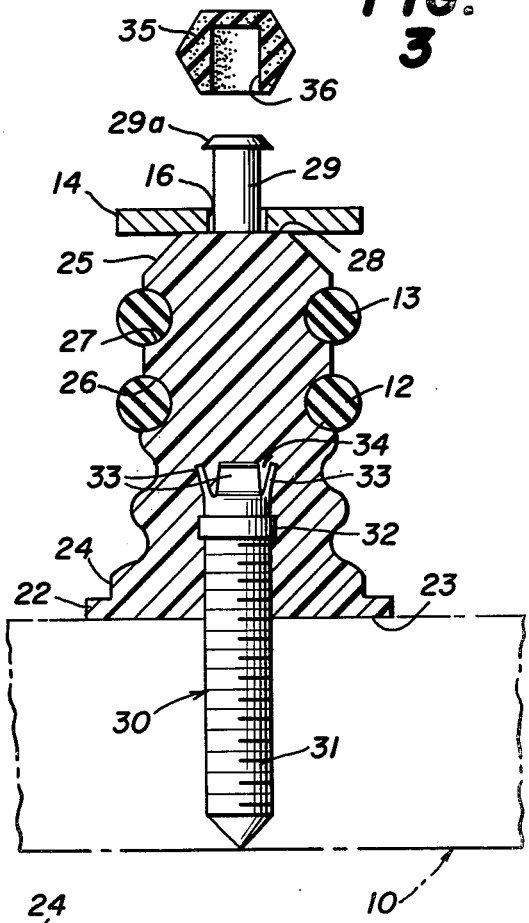
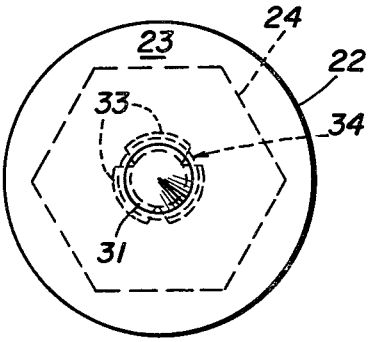
FIG. 4

POST CONSTRUCTION FOR PINBALL GAME

REFERENCE TO RELATED APPLICATION

This application is a continuation-in-part of Application Ser. No. 224,850, filed Jan. 14, 1981, entitled "Post Construction for Pinball Game", and now abandoned.

BACKGROUND OF THE INVENTION

A pinball game has a playfield board and a number of pinballs propelled usually one after another onto the board. Located on the board are various kinds of ball objectives and targets which, when struck, register a score. One of these objectives or targets may be a rubber ring or band encircling a set of posts. A switch (or switches) has a blade protruding through an opening in the playfield board and in contact with the rubber band. When the pinball strikes the band, the switch is actuated, causing a score to be registered. Also, a kicker device may be associated with the rubber band causing the ball to be rebounded at an increased speed. Usually, a decorative plastic plate is carried by the posts which may be illuminated when the score is registered.

U.S. Pat. No. 4,168,067, issued Sept. 18, 1979 and copending Application Ser. No. 180,633 filed Aug. 25, 1980, for Post Assembly for Pinball Game, all disclose post assemblies for pinball games. While these post assemblies are characterized by relative ease of mounting, they all include flanges which either become embedded in the playfield board or hooked therebeneath so as to make removal of the post assembly rather difficult without either access to the underside of the playfield board or damage to the playfield board and/or the post assembly. Furthermore, the copending applications disclose post assemblies which comprise two pieces, viz., a post body and a separate pin for insertion into a bore in the post body. This plural-piece construction complicates manufacture of the post assembly and increases the number of parts to be accounted for in inventory.

Additionally, prior art target assemblies have comprised a plurality of posts encircled by a single rubber band. If a pinball impacted this band with sufficient force, it would tend to deflect the band upwardly and roll beneath it rather than be rebounded thereby.

SUMMARY OF THE INVENTION

It is, therefore, an important object of the present invention to provide a post construction for use in a pinball game which is characterized by economical construction and ease of mounting on and demounting from the playfield board without necessitating access to the underside of the playfield board.

Another object of the invention is to provide a post construction which inhibits marring of the playfield board during mounting.

A further object is the provision of a post construction which can be flush mounted on a playfield board by means of threaded engagement therewith.

It is another object of this invention to provide a post construction of the type set forth which can be interconnected with other such post constructions by rubber rebound bands so as effectively to prevent passage of the pinball beneath the rubber bands.

In connection with the foregoing object, it is another object of this invention to provide a rebound assembly of the type set forth which includes a plurality of post constructions of the character described.

These and other objects of the invention are attained by providing a post construction for use in a pinball game having a playfield board for supporting a rolling pinball thereon, the post construction comprising an elongated post body having a longitudinal axis, and a stud integral with the post body and having an externally threaded portion extending from one end of the post body substantially coaxially therewith, the threaded portion being adapted for threaded engagement with the associated playfield board for mounting the post body thereon in a mounted position, the post body having a driving portion thereon shaped and dimensioned to facilitate gripping thereof for driving the stud into threaded engagement with the playfield board, said driving portion being spaced a slight distance from said one end of said post body and extending laterally outwardly therebeyond around the entire perimeter thereof, whereby when said post body is disposed in its mounted position said driving portion is spaced from the playfield board and conceals said one end of said post body.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

FIG. 1 is a perspective view of a slingshot apparatus on a fragmentary portion of a playfield board in a pinball game, such apparatus including three post constructions incorporating the features of a first embodiment of the present invention;

FIG. 2 is an enlarged view in elevation of one of the post constructions of FIG. 1 mounted on the playfield board and carrying rubber bands and a cover plate of the slingshot apparatus;

FIG. 3 is a view in vertical section taken along the line 3—3 in FIG. 2, but with the cap nut detached;

FIG. 4 is a bottom plan view of the post construction of FIG. 3;

DESCRIPTION OF THE PREFERRED EMBODIMENTS

Figure 5:
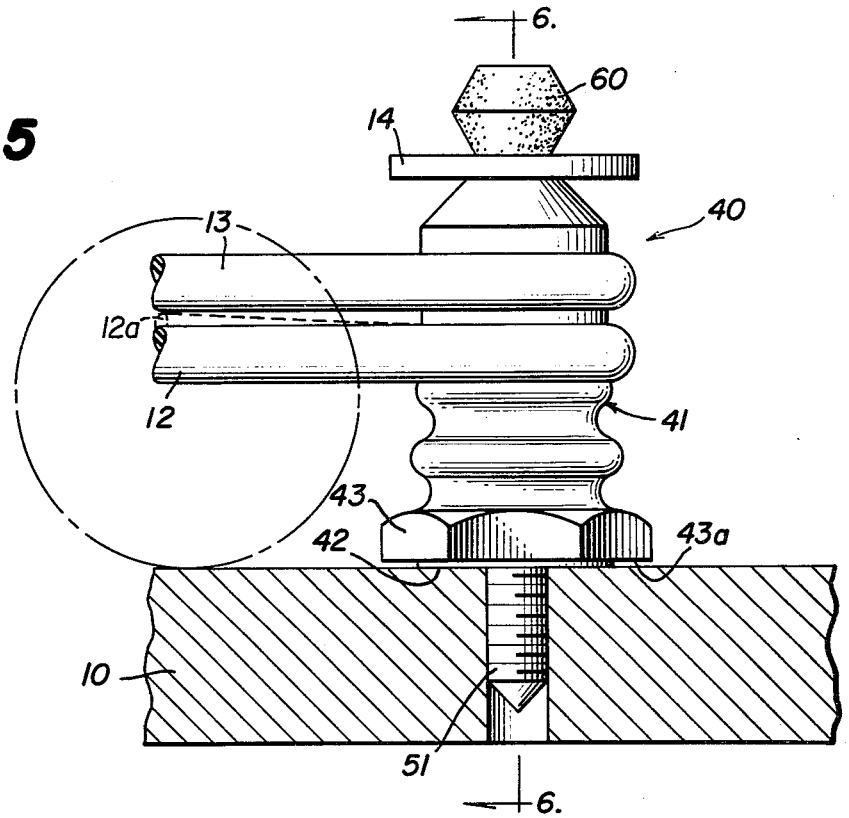
FIG. 5 is a view similar to FIG. 2 illustrating a post construction embodying the features of a second embodiment of the present invention.

Referring to FIG. 1 of the drawings, there is shown a playfield board 10 of a pinball game. Carried on the playfield board 10 are a number of targets which, when struck by a pinball, will register a score. One of these targets is depicted in FIG. 1 and may be characterized as a slingshot apparatus 11. It comprises a set of three posts 20, only two of which are fully shown. Wrapped around the posts 20 are two endless rubber rings or bands 12 and 13, each preferably circular in transverse cross section. The posts 20 carry a cover plate 14 which may be formed of plastic and is usually imprinted with decoration. The plate 14 is preferably at least semitransparent so that a lamp (not shown) beneath it, when illuminated in response to impact of a pinball 15 against the rubber bands 12 and 13, will enhance the decoration imprinted on the cover plate 14. The plate 14 has a plurality of holes 16 (see FIG. 3) therethrough to facilitate attachment to the posts 20, as will be explained more fully below.

The particular apparatus 11 illustrated in FIG. 1 has associated therewith a pair of switches, respectively with switch blades 17 protruding through complementary openings 19 in the playfield board 10, the switches themselves being mounted beneath the board. The blades 17 are in contact with the rubber bands 12 and 13 so that when a pinball 15 strikes the bands, the blades 17 are caused to shift, actuating the switches, which in turn cause a score to be registered. The switches associated with the blades 17 also cause actuation of a solenoid (not shown) which is also disposed beneath the playfield board 10 and which pivots an arm 18 forcefully into the rubber bands 12 and 13, causing the pinball 15 to be rebounded at increased speed.

A pinball game may have one or more apparatuses 11 like that shown in FIG. 1. In addition, other apparatuses may incorporate two or more of the posts 20, one or more rubber bands, a cover plate (perhaps of different shape), and one or more switches. Such other apparatuses may or may not have an arm 18. Also, each apparatus may include a lamp beneath the cover plate 14 for illumination thereof when the apparatus is impacted by the pinball 15.

Referring to FIGS. 2 through 4 of the drawings, details of one of the posts 20 will be described, it being appreciated that the posts 20 are all identical in construction. The post 20 has an elongated post body, generally designated by the numeral 21, and provided at one end thereof with a flat, radially outwardly extending annular flange 22 having a flat, circular bottom surface 23. Extending upwardly from the top surface of the flange 22 is a drive surface 24, substantially hexagonal in shape, to facilitate gripping of the post body 21 by an associated tool such as an end wrench or the like, for a purpose to be explained more fully below. The flange 22 is dimensioned to extend radially outwardly beyond the drive surface 24. The post body 21 is provided at the other end thereof with a frustoconical outer surface 25 terminating in a flat top surface 28 disposed substantially parallel to the bottom surface 23.

Formed in the outer surface of the post body 21 between the frustoconical surface 25 and the drive surface 24 are two substantially identical peripheral grooves 26 and 27 which extend around the post body 21, each of the grooves 26 and 27 being substantially semicircular in transverse cross section and adapted for seating therein an associated one of the rubber bands 12 and 13. Preferably, the grooves 26 and 27 are disposed closely adjacent to each other so that, when respectively seated therein, the rubber bands 12 and 13 will be spaced apart a distance less than the diameters thereof. Integral with the post body 21 and extending outwardly therefrom coaxially therewith centrally of the top surface 28 is a cylindrical lug 29, provided at the distal end thereof with a radially outwardly extending annular attachment flange 29*a*.

Embedded in the post body 21 substantially coaxially therewith is an elongated stud, generally designated by the numeral 30, which has an externally threaded portion 31 which projects a predetermined distance beyond the bottom surface 23 of the post body 21. The stud 30 is also provided with a split head 32 provided with three outwardly deflected prongs 33 separated by notches 34 better to anchor the stud 30 in the post body 21.

In use, the threaded portion 31 of the stud 30 is threadedly engaged in a complementary opening in the playfield board 10 for securely mounting the post 20 in a mounted position illustrated in FIGS. 2 and 3, with the bottom surface 23 disposed in engagement with the upper surface of the playfield board 10. It will be appreciated that driving of the post 20 to this mounted position is facilitated by the use of an end wrench or the like in engagement with the drive surface 24 of the post body 21. The flange 22 serves to protect the playfield board 10 from damage by the wrench or other tool during mounting of the post 20.

When all of the posts 20 of the slingshot apparatus 11 have thus been mounted on the playfield board 10, the rubber bands 12 and 13 are extended around all three posts and respectively seated in the grooves 26 and 27 thereof. The groove 26 is so positioned that when the posts 20 are mounted in their mounted position illustrated in the drawings, the center of the rubber band 12 will be spaced from the playfield board 10 a distance "h" which is approximately equal to the radius "r" of the pinball 15 and is preferably slightly greater than the radius "r". Thus, when the pinball 15 impacts on the slingshot apparatus 11, it tends to kick downwardly on rebound and to deflect the band 12 upwardly, as indicated at 12*a* in FIG. 5.

Furthermore, it is a significant feature of the present invention that the rubber bands 12 and 13 are very close to each other. Therefore, if the rubber band 12 is deflected upwardly in response to impact of a pinball 15 thereon, it will engage the rubber band 13 which will tend to inhibit further vertical deflection of the rubber band 12 and thereby serve to prevent passage of the pinball 15 beneath the bands 12 and 13.

When the rubber bands 12 and 13 have thus been assembled on the posts 20, the cover plate 14 is positioned on the top surfaces 28 thereof, with the lugs 29 respectively passing upwardly through the holes 16 in the cover plate 14. Each of the posts 20 is provided with a cap 35 having a recess 36 therein and adapted to be press fitted on the top of the lug 29 for engagement with the attachment flange 29*a* thereof securely to hold the cover plate 14 in place.

Figure 6:
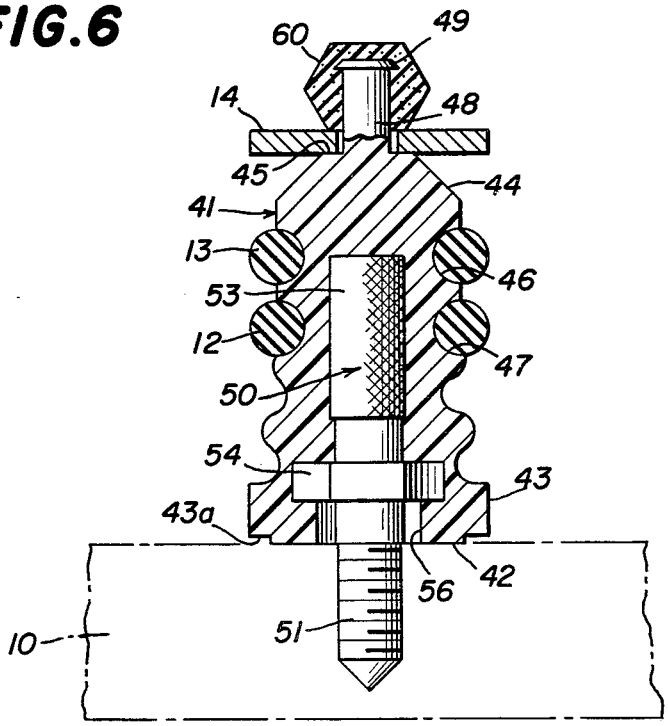
FIG. 6 is a view in vertical section taken along the line 6—6 in FIG. 5.
Figure 7:
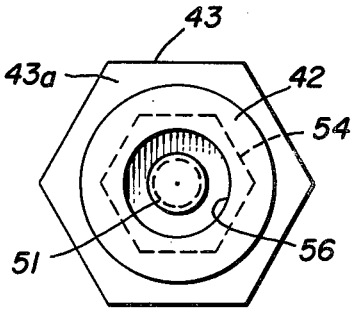
FIG. 7 is a bottom plan view of the post construction of FIG. 6.

Referring now to FIGS. 5 through 7 of the drawings, there is illustrated a post 40, constructed in accordance with a second embodiment of the present invention. The post 40 has an elongated post body, generally designated by the numeral 41, and provided at one end thereof with a flat circular end surface 42. The post body 41 has a drive portion 43, substantially hexagonal in shape, the drive portion 43 having a bottom surface 43*a* spaced longitudinally of the post body 41 a slight distance from the end surface 42 and extending laterally outwardly therebeyond around the entire perimeter thereof. The drive portion 43 serves the same function as the drive surface 24, described above in connection with FIGS. 2 and 3. The post body 41 is provided at the other end thereof with a frustoconical outer surface 44 terminating in a flat top surface 45 disposed substantially parallel to the end surface 42.

Formed in the outer surface of the post body 41 between the frustoconical surface 44 and the drive portion 43 are two substantially identical peripheral grooves 46 and 47 which extend around the post body 41, each of the grooves 46 and 47 being substantially semicircular in transverse cross section and adapted for seating therein an associated one of the rubber bands 12 and 13. Preferably, the grooves 46 and 47 are disposed closely adjacent to each other so that, when respectively seated therein, the rubber bands 12 and 13 will be spaced apart a distance less than the diameters thereof. Integral with the post body 41 and extending outwardly therefrom coaxially therewith and centrally of the top surface 45 is a cylindrical lug 48, provided at the distal end thereof with a radially outwardly extending annular flange 49.

Embedded in the post body 42 substantially coaxially therewith is an elongated stud, generally designated by the numeral 50, which has an externally threaded portion 51 which projects a predetermined distance beyond the end surface 42 of the post body 41. The stud 50 is also provided with a knurled portion 53 and a laterally outwardly extending hexagonal mounting flange 54, better to anchor the stud 50 in the post body 41. Formed in the end surface 42 and extending axially thereinto in surrounding relationship with the stud 50 is an annular recess 56.

In use, the post 40 is threadedly engaged in a complementary opening in the playfield board 10 for securely mounting the post 40 in a mounted position illustrated in FIGS. 5 and 6, in much the same manner as was described above in connection with the post 20. However, in this case the post 40 is screwed into the playfield board 10 until the end surface 42 engages the upper surface of the playfield board 10, in which position the bottom surface 43*a* of the drive portion 43 will be spaced a slight distance above the playfield board 10. This is significant since the hexagonal edges of the drive portion 43 could score or dig into the playfield board 10 if screwed too tightly thereagainst, particularly when a tool such as a wrench is used for mounting the post 40. The offset provided by the slight displacement of the bottom surface 43*a* of the drive portion 43 from the end surface 42 effectively prevents the drive portion 43 from being brought into contact with the playfield board 10. Furthermore, because the drive portion 43 extends laterally outwardly well beyond the perimeter of the end surface 42, should the playfield board 10 be scored by the end surface 42 this scoring will not be visible to a user of the game.

A drawback of prior post constructions is that when the threaded portion is screwed into the playfield board, small curls or whiskers of the playfield board material 10 tend to be pushed upwardly above the playfield board by the screw threads and this can prevent proper seating of the post against the playfield board 10. Accordingly, it is another significant feature of this invention that the annular recess 56 serves to accommodate any such curls of material which may be ejected by the screw threads and will permit the end surface 42 to be seated flush against the upper surface of the playfield board 10.

The post 40 cooperates with the rubber bands 12 and 13 and the cover plate 14 in the same manner as was described above in connection with FIGS. 1 through 3. Similarly, the post 40 is provided with a cap 60 having a recess therein and adapted to be press fitted on top of the lug 48 for engagement with the attachment flange 49, thereby to securely hold the cover plate 14 in place.

Preferably, the post bodies 21 and 41 are of molded one-piece construction and are molded around the studs 30 and 50 to provide integral constructions. In the preferred embodiments the grooves 26, 27, 46 and 47 in the posts 20 and 40 are spaced apart a distance substantially equal to the radii thereof.

From the foregoing, it can be seen that there has been provided an improved post construction for a pinball game which is characterized by an economical construction and ease of assembly. More particularly, the post construction can be easily mounted on and demounted from the playfield board from thereabove, by the use of only a simple tool such as an end wrench and without damage to the playfield board.

There has also been provided an improved target apparatus for a pinball game comprising a plurality of posts encircled by two rubber bands so arranged as effectively to prevent vertical deflection thereof sufficient to permit passage of a pinball therebeneath.

I claim:

1. A post construction for use in a pinball game having a playfield board for supporting a rolling pinball thereon, said post construction comprising an elongated unitary one-piece post body having a longitudinal axis, said post body having a length substantially greater than its transverse diamensions, and a stud integral with said post body and having an externally threaded portion extending from one end of said post body substantially coaxially therewith, said threaded portion being adapted for threaded engagement with the associated playfield board for mounting said post body thereon in a mounted position with said one end in contact with the playfield board, said post body having a driving portion thereon having an external driving surface shaped and dimensioned to facilitate gripping thereof by an associated driver for driving said stud into threaded engagement with the playfield board, said driving portion being spaced a slight distance from said one end of said post body and extending laterally outwardly therebeyond around the entire perimeter thereof, whereby when said post body is disposed in its mounted position said driving portion is spaced from the playfield board and conceals said one end of said post body.

2. The post construction of claim 1, wherein said one end of said post body is substantially circular in transverse cross section.

3. The post construction of claim 1, wherein said driving portion is hexagonal in shape.

4. The post construction of claim 1, and further including two peripheral grooves formed in the outer surface of said post body and extending therearound, each of said grooves being substantially semicircular in transverse cross section.

5. The post construction of claim 1, wherein said post body has a recess formed in said one end thereof and extending axially thereinto in surrounding relationship with said stud, said recess accommodating fragments of the playfield board ejected by the threaded portion of said stud to facilitate flush engagement of said one end of said post body against the playfield board.

6. The post construction of claim 5, wherein said recess is annular in shape and is coaxial with said stud.

7. A post construction for use as part of a target assembly including two plastic bands encircling the assembly in a pinball game having a playfield board for supporting on the upper surface thereof a rolling pinball having a predetermined radius, said post construction comprising a post body, and mounting means carried by said post body at one end thereof for mounting said post body on the associated playfield board in a mounted condition with said one end of said post body in abutting engagement with the upper surface of the playfield board, said post body having two peripheral grooves formed in the outer surface thereof and extending therearound closely adjacent to each other, each of said grooves being substantially semicircular in transverse cross section and dimentioned to seat therein one of the associated elastic bands, the one of said grooves closest to said one end of said post body being spaced therefrom a distance approximately equal to the predetermined radius of the associated pinball, whereby the associated bands will be disposed for engagement with each other when one of them is engaged by a rolling pinball so as to inhibit vertical deflection of the bands.

8. The post construction of claim 7, wherein said grooves are substantially identical in dimension and are spaced apart longitudinally of said post body a distance substantially less than the cross-sectional diameters thereof.

9. A target assembly for a pinball game having a playfield board for supporting thereon a rolling pinball having a predetermined diameter, said target assembly comprising a plurality of spaced-apart posts mounted on the playfield board, each of said posts having two peripheral grooves formed in the outer surface thereof, the lower one of said grooves being spaced from the playfield board a distance less than the predetermined diameter of the associated pinball, and two elastic bands encircling said posts and respectively seated in said two grooves of each post for engagement with an associated pinball rolling on the playfield board, said grooves being disposed closely adjacent to each other so that said elastic bands are disposed for engagement with each other when one of them is engaged by a rolling pinball between said posts to inhibit vertical deflection of said bands.

10. The target assembly of claim 9, wherein said grooves are substantially semicircular in transverse cross section and substantially identical in dimension, the lower one of said grooves having the cross-sectional center thereof spaced from the playfield board a distance approximately equal to the radius of the associated pinball.

11. The target assembly of claim 10, wherein said grooves and said bands are spaced apart longitudinally of said posts a distance substantially less than the cross-sectional diameters thereof.

12. A post construction for use in a pinball game having a playfield board for supporting on the upper surface thereof a rolling pinball having a predetermined radius, said post construction comprising a post body, and a threaded mounting stud carried by said post body at one end thereof for mounting said post body on the associated playfield board in a mounted condition with said one end of said post body in abutting engagement with the upper surface of the playfield board, said post body having two peripheral grooves formed in the outer surface thereof and extending therearound, each of said grooves being substantially semicircular in transverse cross section, the one of said grooves closest to said one end of said post body being spaced therefrom a distance approximately equal to the predetermined radius of the associated pinball, said post body having an external driving portion thereon shaped and dimensioned to facilitate gripping thereof by an associated tool for driving said stud into threaded engagement with the playfield board, said driving portion being spaced a slight distance from said one end of said post body and extending laterally outwardly therebeyond around the entire perimeter thereof, whereby when said post body is disposed in its mounted position, said driving portion is spaced from the playfield board and conceals said one end of said post body.

* * * * *